US005947161A

United States Patent [19]

Speich

[11] Patent Number: 5,947,161

[45] Date of Patent: Sep. 7, 1999

[54] PINCH ROLL WEFT FEEDER WITH EXPANDABLE TRANSPORT ROLL

[75] Inventor: Francisco Speich, Gipf-Oberfrick, Switzerland

[73] Assignee: Textilma AG, Hergiswil, Switzerland

[21] Appl. No.: 08/981,171

[22] PCT Filed: Jun. 15, 1995

[86] PCT No.: PCT/CH95/00134

§ 371 Date: Dec. 12, 1997

§ 102(e) Date: Dec. 12, 1997

[87] PCT Pub. No.: WO97/00342

PCT Pub. Date: Jan. 3, 1997

[51] Int. Cl.[6] ..... D03D 47/34; B65H 51/06

[52] U.S. Cl. ..... 139/22; 226/175; 226/191; 139/450

[58] Field of Search ..... 242/151; 226/175, 226/176, 191, 182, 183; 139/450, 22, 452; 66/132 R

[56] References Cited

U.S. PATENT DOCUMENTS

| | | | |
|---|---|---|---|
| 3,224,467 | 12/1965 | Gagliardo . | |
| 3,339,590 | 9/1967 | Libby . | |
| 3,757,619 | 9/1973 | Gianese | 226/175 |
| 4,383,631 | 5/1983 | Fairchild | 226/186 |
| 4,466,576 | 8/1984 | Simson | 242/47.01 |

FOREIGN PATENT DOCUMENTS

| | | |
|---|---|---|
| 7225556 | 7/1972 | France . |
| 2752094 | 11/1977 | Germany . |
| 2027070 | 7/1979 | United Kingdom . |

*Primary Examiner*—Andy Falik

*Attorney, Agent, or Firm*—Hovey, Williams, Timmons & Collins

[57] ABSTRACT

A transport roller (10) is provided on a ribbon loom and a press roller (12) is forced against said transport roller to grip a bobbin supply thread (26). In order to simplify adjustment of the transport speed while keeping the speed of the transport roller constant, a friction surface (32) is provided on the outside of the transport rollers casing or jacket (78) and can be expanded radially by an adjustment device (66, 72).

17 Claims, 4 Drawing Sheets

PINCH ROLL WEFT FEEDER WITH EXPANDABLE TRANSPORT ROLL

BACKGROUND OF THE INVENTION

1. Field of the Invention

The innovation concerns a thread transport device for a textile machine having a drivable transport roller arranged on a shaft.

2. Description of the Prior Art

The most varied embodiments of thread transport devices are known. In German Patent DE-PS 946 177, a thread transport device of the type described in the Field of the Invention relates to the feeding of a elastic thread to a circular knitting machine. In this known thread transport device, the transport roller used for transporting the tread is situated on a friction disk and is supported by an arm, whose end that is oriented away from the transport roller is pivotally attached to a guide shaft. The guide shaft is aligned in such a way that, as a result of the longitudinal movement, the distance of the transport roller from the center of the friction disk can be changed, thereby also changing the circumferential speed of the transport roller. A contact pressure roller, positioned on the side of the transport roller oriented away from the friction disk abuts and is supported on a lever of the transport roller. The lever is pivoted on its end that is oriented away from the contact pressure roller. The contact pressure force of the transport roller on the friction disk, as well as the contact pressure force of the contact pressure roller on the transport roller can be changed and/or adjusted as a result of the lode weights. This known thread transport device has certain disadvantages, including a relatively complicated design and a relatively large space requirement because of use of the friction disk. That is, a relatively large space is required because only one radial beam of one friction disk can be used, but space for the remainder of the friction disk must be made available. It is also disadvantageous that the precision of the thread transport is negatively affected by a number of effects, so that, for example, a friction coefficient change results from the change of the operating temperature between the cold and the warm state of the machine. Changes with respect to humidity, temperature and air pollution also cause friction coefficient changes, and, as a result, fluctuations of the drive mechanism. The circular movement of the friction disk or the transport roller as well as the fluctuating contact pressure can also have a negative effect on the transport precision of the thread. An additional aggravation is the fact that the thread to be transported lies simply between the contact pressure roller and the transport roller and cannot be looped around the transport roller because otherwise its support by the friction roller would be negatively affected. As a result of the relatively short contact path of the thread on the transport roller and/or the contact pressure roller, the additional disadvantage results that slipping through of the thread at the transport roller can occur, thus also subjecting the supply of the thread to inaccuracies.

The object of the innovation is additionally improving a thread transport device of the type stated in the introduction in such a way that the disadvantages of the state of the art are overcome.

The object is achieved by the characterizing features of the thread transport device as described herein.

SUMMARY OF THE INVENTION

Because with an otherwise constant number of revolutions, the transport speed can only be changed by expansion of the jacket of the transport roller with an otherwise constant number of revolutions, a particularly simple design of the transport device results because the transport speed can be adapted in the simplest manner by changing the diameter of the transport roller. As the transport roller diameter increases, with a constant number of revolutions, an increase in the transport speed results. Inversely, a reduction of the transport roller diameter leads to a reduction in the conveying speed. The thread transport device can be constructed in an extremely compact manner, therefore only requires very little space when being built into a machine. Additionally, the design of the device is very simple and hence cost-effective.

The jacket may be made of the most varied materials, for example from a roughened steel band strip that overlaps itself in a circumferential direction and is held by an expandable support device. More advantageous is an enhancement where the expandable jacket is of an elastomeric material which is particularly inexpensive and, at the same time, also supplies a jacket surface having an increased friction coefficient.

For the enhancement of the adjustment device, the most varied possibilities also result, the use of a regulator block of substantially incompressible elastomer material positioned between the shaft and the jacket and support device being connected to the jacket, with the regulator block clamped in an axial position between two presser links, one being adjustable, presenting a very simple space-saving solution shown and described herein. The adjustment process can proceed in a most simple manner in the enhancement where a threaded section is provided on the shaft and arranged on an adjusting nut that interacts with an adjustable presser link, adjustment, however, in that case, only being possible with the thread transport device at a standstill.

An additional variant of the adjustment device is described herein, wherein the expandable jacket is conical on the side situated radially inside and interacts with a counterconical regulator on a shaft of a transport roller. The jacket and the counterconical regulator link gain adjustable realtive to each other in an axial direction by means of an adjusting device. The adjustment device necessary for adjustment can be embodied with a counterconical regulator link arranged to be stationary on the shaft of the transport roller, and wherein the adjusting device has a sleeve acting laterially on the jacket which, by means of any adjusting disk, is adjustable coaxial to the shaft of the transport roller. Here again, adjustment is only possible with the transport device at a standstill.

If the diameter of the thread transport roller is to be changeable even during operation, an enhancement characterized by a stationery adjusting device having driving means that interact with the presser link or the adjusting disk via a coupling link is advantageous. The stationary adjustment device can be designed in the most varied manners, starting with a simple adjusting screw, across a motor-driven spindle drive, through fluid-activated piston cylinder groups.

By arranging the contact pressure roller at the free portion of a uniaterally pivoted lever which is pretensioned against the transport roller presents a particularly simple embodiment and support of the contact pressure roller.

For the arrangement of the thread to be transported on the transport roller and on the contact pressure roller, the most varied possibilities result. In the simplest case, contact between the thread to be transported and the transport roller and the drive roller can result simply by passing the thread through, at the point of contact, between the transport roller and the contact pressure roller. The precision and safety of the thread transport can be improved by the enhancement where the thread partially loops around the transport roller and can be removed via the contact pressure roller, the thread also being partially looped around the contact pressure roller because, as a result of the partial looping of the thread around the contact pressure roller, the applicable friction force is considerably increased.

Fluctuations in the thread transport and/or thread use can be compensated by an enhancement of the thread transport device wherein the transport roller and contact pressure roller are followed by a pneumatic compensation device.

It may potentially be expedient to use the change in the transport speed caused by a change in the diameter of the thread transport roller for adjustment and compensation purposes only and to perform major drive adjustments by an enhancement of the thread transport device where the shaft of the transport roller is connected to a variable speed driving device. The mentioned advantages come to bear particularly in an enhancement of the thread transport device in accordance with the preferred embodiment, where two and more thread transport rollers are arranged next to each other on a drivable shaft, their transport characteristics must, on the one hand, be adjusted to each other and, on the other hand, to the thread use.

Sample embodiments of the object of the innovation are described hereinafter in greater detail based on the drawings.

DESCRIPTION OF THE PREFERRED EMBODIMENT

Figure 1:
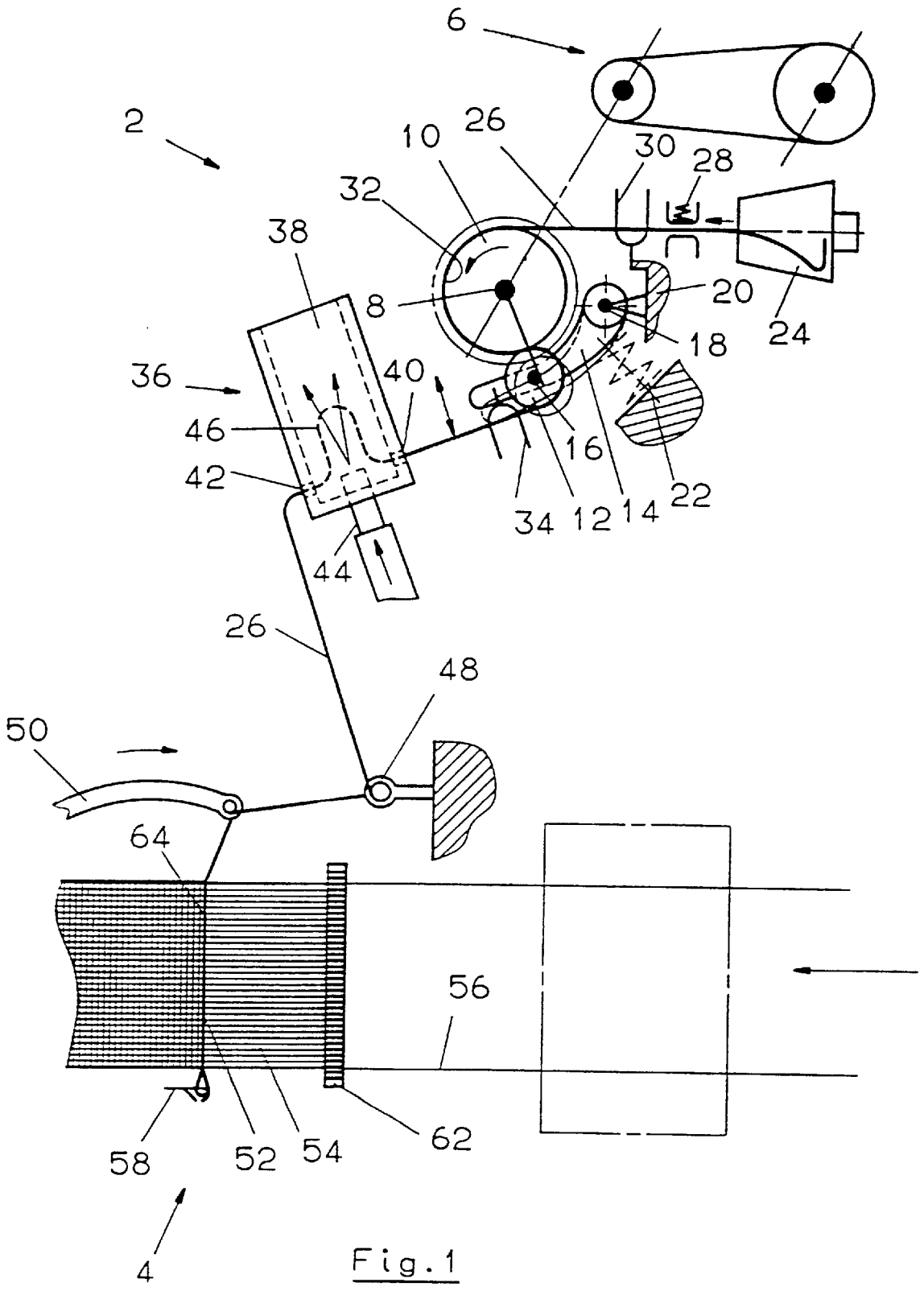
FIG. 1 A thread transport device on a ribbon loom in a schematic representation.

FIG. 1 shows a thread transport device 2 on a schematically represented ribbon loom 4. The thread transport device comprises a drive mechanism 6, which is coupled with the shaft 8 of a thread transport roller 10. Interacting with the latter, is a contact pressure roller 12, which is arranged rotatable on a lever 14, via a shaft 16. Lever 14 is attached, by the end oriented away from contact pressure roller 12, via a joint 18, to a stationary carrier 20. A spring 22 is used for pretensioning the contact pressure roller 12 against the thread transport roller 10.

Transport roller 10 pulls off a supply bobbin 24 a thread 26, which runs first through a thread brake 28 and a thread guide 30 before making contact with friction surface 32 of transport roller 10. Thread 26 is then guided along part of the circumference of transport roller 10 and passes under contact pressure roller 12 and is taking up from it, also being guided along part of the circumference of contact pressure roller 12. After contact pressure roller 12, via an additional thread guide 34, thread 26 reaches a pneumatic compensation device 36. The latter comprises a narrow groove 38 through which the thread is guided via an inlet opening 40 and an outlet opening 42. A nozzle 44 blows an air blast into groove 38 and forms a thread loop 36 when the thread shows an excess supply during processing.

From compensation device 36, via a stationary thread guide eye 48, the thread reaches a weft insertion needle 50, which introduces into shed 54 a weft loop 52 of warps 56. On the side of the fabric that is oriented away from weft insertion needle 50, a weaving needle 58 is used for tieing off weft loop 52. By means of a weaving reed 62, the weft loop is cast on weave point 64.

Figure 2:
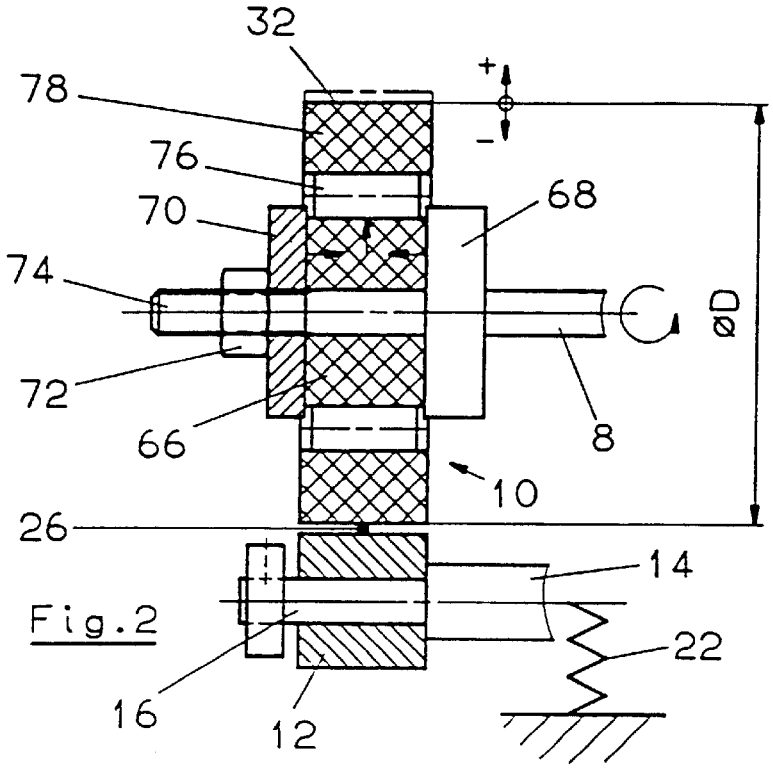
FIG. 2 A transport roller and a contact pressure roller in a cross section through their axes.

FIG. 2 shows a first embodiment of a transport roller 10 and a contact pressure roller 12. Transport roller 10 has, on shaft 8, a regulator block 66 that is formed of a quasi incompressible elastomer material. This regulator block is clamped between two presser links 68,70, the first presser link 68 of them being arranged stationary on shaft 8 and the second presser link 70 consisting of a disk 70 that is movable on the shaft and is tensionable, by means of an adjusting nut 72, against the first presser link 68. For this purpose, adjusting nut 72 is arranged on a threaded section 74 of the shaft. By compressing the presser links 68,70, regulator block 66 is expanded in a radial direction and acts, across a support device 76, for example in the form of cylindrical bodies or of a slotted sleeve with end sections that overlap in a circumferential direction, on a jacket 78, which forms friction surface 32. Jacket 78 preferably also consists of elastomer material. By compressing regulator block 76 by means of the presser links 68,70, jacket 78 is pushed radially outward so that diameter D increases. During detensioning of regulator block 66 by means of the presser links 68,70, jacket 78 contracts causing a reduction of diameter D. Situated on jacket 78, on friction surface 32, is thread 26, which is pushed, by means of contact pressure roller 12, against transport roller 10. FIG. 2 also schematically indicates how contact pressure roller 12 is arranged on shaft 16 and is held in place on lever 14, which, by means of spring 22, is pretensioned against transport roller 10.

Figure 3:
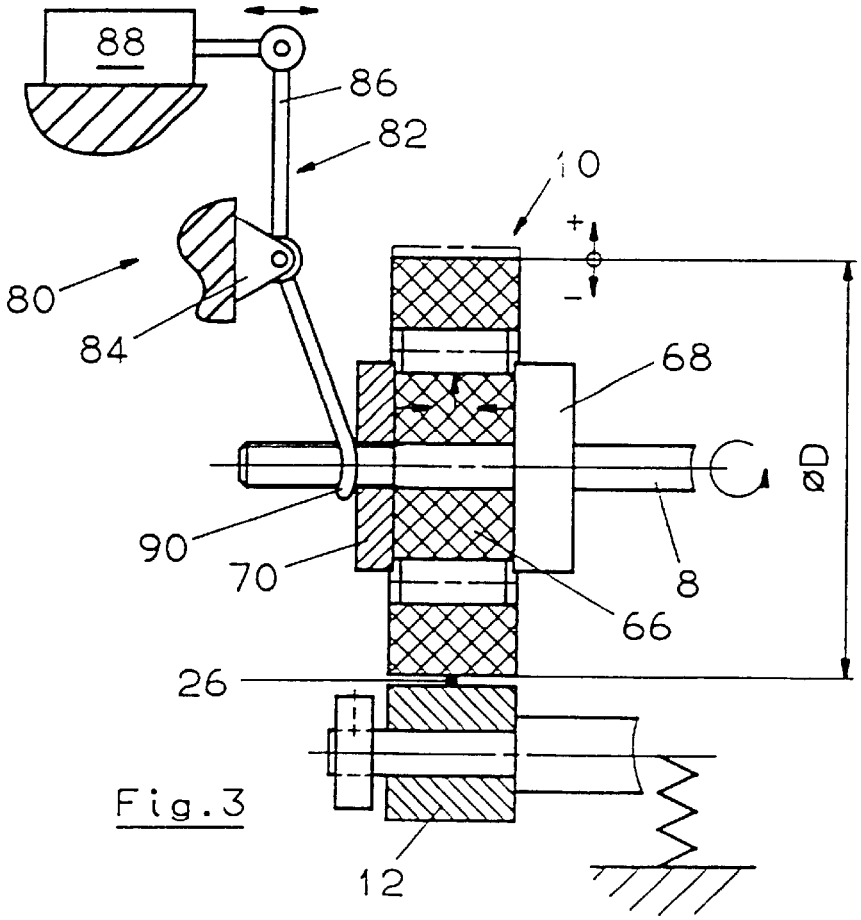
FIG. 3 The transport roller and the contact pressure roller of FIG. 2 with a modified adjustment device.

FIG. 3 shows an arrangement of transport roller 10 and contact pressure roller 12 corresponding to FIG. 2, however, with adjusting nut 72 being replaced by a stationary adjusting device 80 formed of a dual-arm coupling link 82, which is pivotally supported by a stationary support block 84. At the end 86 that is oriented away from transport roller 10, coupling link 82 is connected to a driving means 88 that can be randomly designed, namely as anything from a simple regulating screw, to a drive shaft and even a fluid-activated cylinder group. The arm 90 that is oriented towards presser link 70 is designed forked and cooperates with presser link 70 so that regulator block 66, can be more or less compressed as a function of the position of the driving means 88.

Figure 4:
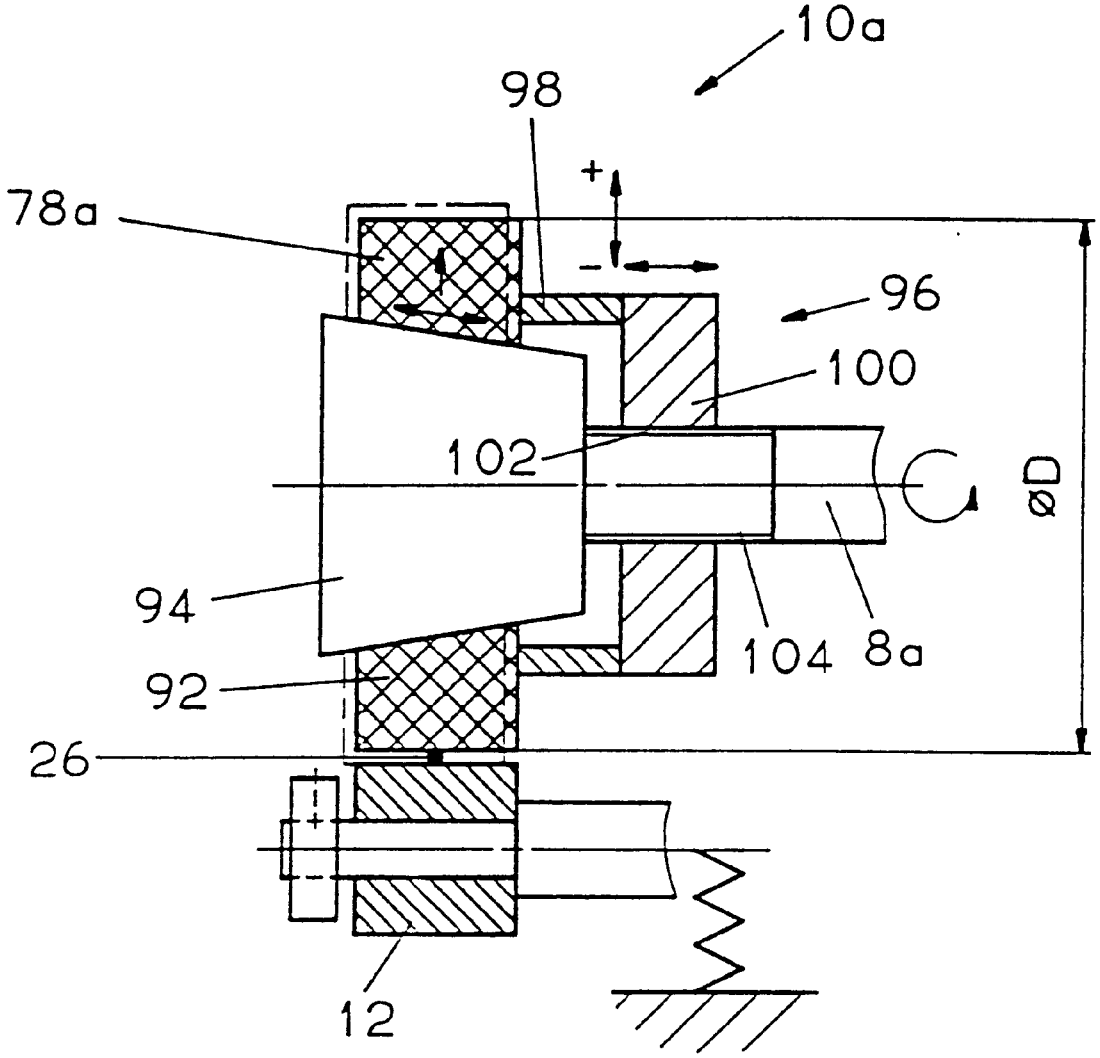
FIG. 4 An additional transport roller with contact pressure roller as well as an additional adjustment device in a cross section through their axes.

FIG. 4 shows an additional arrangement of a transport roller 10*a* and a contact pressure roller 12. Jacket 78*a* of transport roller 10*a* is designed conical on side 92 that is situated radially inside and cooperates with a counterconical regulator link 94, which is arranged stationary on shaft 8*a*. An adjustment device 96 has a sleeve 98 that acts laterally on jacket 78*a* and is supported by an adjusting disk 100 that is arranged coaxial to shaft 8*a*. Adjusting disk 100 comprises, for this purpose, a central threaded orifice 102, which is screwed to a threaded section 104 of shaft 8*a*. Adjusting device 96 determines, by means of adjusting disk 100, the axial position of jacket 78*a* on the conical regulator link 94, with diameter D of jacket 78*a* accordingly increased or reduced. Instead of adjusting disk 100 that can be screwed back and forth on shaft 8*a*, an external stationary regulating device can be provided for activation of the disk, as described in FIG. 3.

Figure 5:
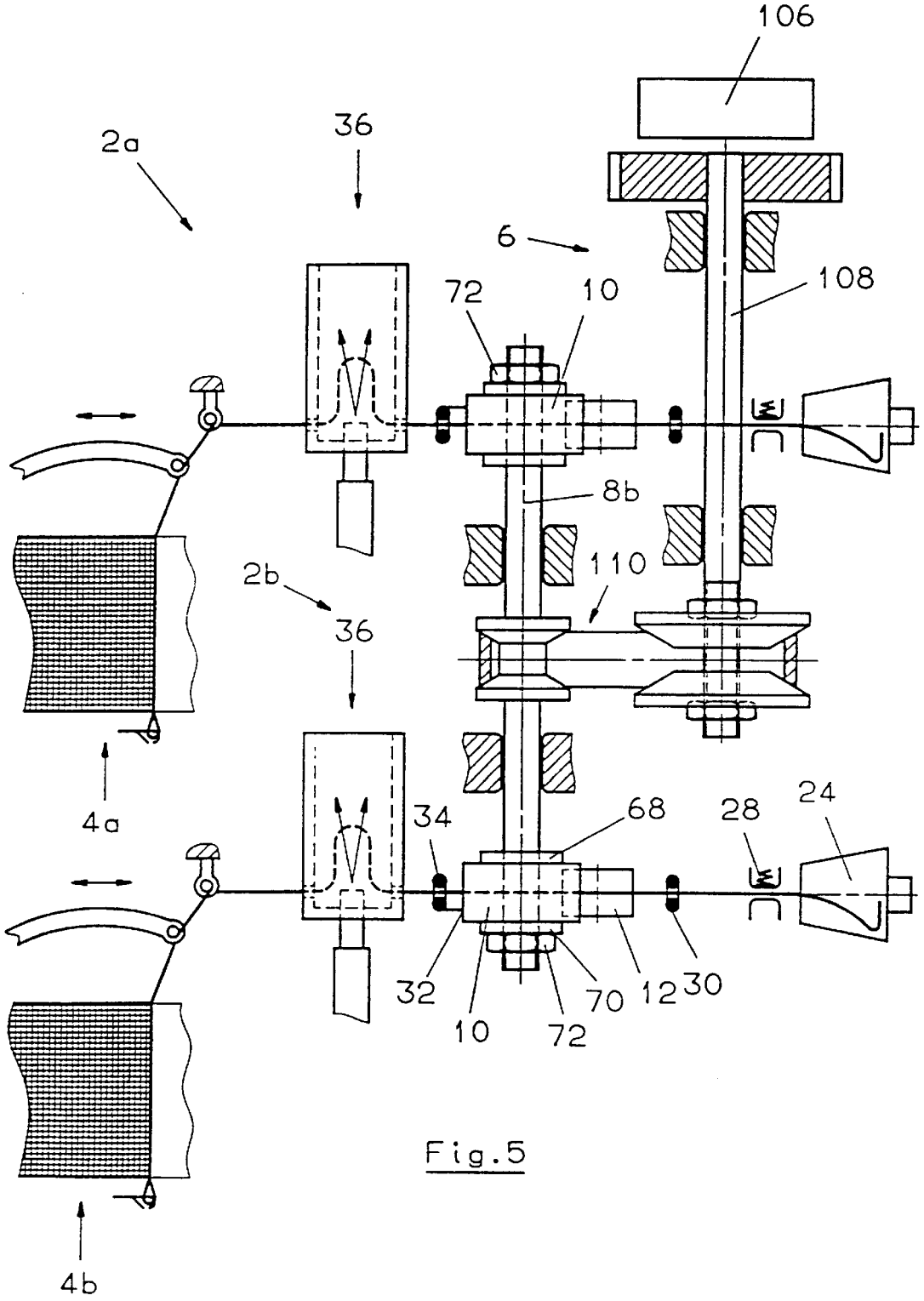
FIG. 5 A multiple arrangement of thread transport devices with a joint drive in a schematic representation.

FIG. 5 shows the arrangement of two thread transport devices 2*a* and 2*b*, which have been designed in analogy to the thread transport device of FIGS. 1 and 2. These thread transport devices have a common shaft 8*b* and are activated by a joint driving device 6. The latter comprises a motor 106 that drives a drive shaft 108, which is connected, via a variogear 110, to shaft 8*b* of the thread transport devices. By changing the numbers of revolutions of motor 106 and/or a change in the transmission ratio of variogear 110, the number of revolutions can be jointly adjusted for all the thread transport devices 2*a*,2*b*. The thread transport speed can be individually fine-tuned and adapted at the individual ribbon looms 4*a*,4*b*, i.e. at the individual weaving stations by means of the adjusting nuts 72 by adaptation of the diameter of the transport rollers 10.

By means of the thread transport device in accordance with the innovation, a whole set of significant advantages thus come about. Thus, an absolute, positive, and precise thread transport amount and its adjustment is assured by:

a) The looping of the thread at the transport roller and the pressing down of the thread by means of the contact pressure roller;

b) the thread quantity adjustment by increasing or decreasing the diameter of the transport roller diameter without changing the number of revolutions of the transport roller and/or c) the individual tuning of several thread transport devices arranged on a joint drive shaft.

Based on the looping of the thread on the friction surface of the thread transport device, on the one hand, and the pressing down of the thread by means of the contact pressure roller, on the other hand, a forced control results and a forced transport of the thread results that is not susceptible to exterior effects such as temperature, climate and pollution. Finally, as a result of the extremely simple design and adjustment, the thread transport device is extremely space-saving and can, therefore, be used and operated even in the most restricted areas. Furthermore, because of the very low number of components, it is not only cost-effective but additionally shows reduced wear susceptibility.

As a result of the forced precise drive of the thread by means of the thread transport device, there is practically no slippage during starting and stopping of the weaving loom so that weaving defects that otherwise frequently occur, are avoided. The same applies to an exact maintenance of the band width as a result of the exact controlled feeding of the thread for a weft insertion needle.

| REFERENCE | |
|---|---|
| 2 | Thread transport device |
| 2a | Thread transport device |
| 2b | Thread transport device |
| 4 | Ribbon loom |
| 4a | Ribbon loom |
| 4b | Ribbon loom |
| 6 | Drive mechanism |
| 8 | Shaft |
| 8a | Shaft |
| 8b | Shaft |
| 10 | Transport roller |
| 10a | Transport roller |
| 12 | Contact pressure roller |
| 14 | Lever |
| 16 | Shaft |
| 18 | Joint |
| 20 | Carrier |
| 22 | Spring |
| 24 | Supply bobin |
| 26 | Thread |
| 28 | Thread brake |

-continued

| REFERENCE | |
|---|---|
| 30 | Thread guide |
| 32 | Friction guide |
| 34 | Thread guide |
| 36 | Pneumatic compensation device |
| 38 | Groove |
| 40 | Inlet opening |
| 42 | Outlet opening |
| 44 | Nozzle |
| 46 | Thread loop |
| 48 | Stationary thread guide eye |
| 50 | Weft insertion needle |
| 52 | Weft loop |
| 54 | Shed |
| 56 | Warp |
| 58 | Weaving needle |
| 62 | Weaving reed |
| 64 | Weaving station |
| 66 | Regulator block |
| 68 | Stationary presser link |
| 70 | Presser link |
| 72 | Adusting nut |
| 74 | Threaded section |
| 76 | Support device |
| 78 | Jacket |
| 78a | Jacket |
| 80 | Stationary adjusting device |
| 82 | Couplig link |
| 84 | Support block |
| 86 | End of 82 |
| 88 | Driving means |
| 90 | Forked arm |
| 92 | Conical inside |
| 94 | Regulator link |
| 96 | Adjusting device |
| 98 | Sleeve |
| 100 | Adjusting disk |
| 102 | Threaded orifice |
| 104 | Threaded section |
| 106 | Motor |
| 108 | Drive shaft |
| 110 | Variogear |

I claim:

1. A thread transport device for a textile machine, including but not limited to a ribbon loom comprising:

a shaft;

a drivable transport roller with variable circumferential speeds and a friction surface arranged on said shaft; and a pretensioned contact pressure roller with inclusion of a thread to be transported, against the transport roller, wherein the friction surface is formed by a seamless jacket that is radially expandable by means of a regulator device, the transport roller and the contact pressure roller are followed by a pneumatic compensation device for the thread, and including at least two thread transport devices and a joint drivable shaft carrying said thread transport devices.

2. A thread transport device in accordance with claim 1, wherein the expandable jacket consists of an elastomer material.

3. A thread transport device in accordance with claim 2, wherein the regulator device has a regulator block of substantially incompressible elastomer material arranged between the shaft and the jacket with a support device being interconnected to the jacket, said regulator block being clamped in an axial direction between two presser links counteracting each other, at least one of the presser links being adjustable.

4. A thread transport device in accordance with claim 2, wherein the regulator device includes a counterconical regulator link on said shaft carrying said transport roller, and the expandable jacket has a conical inner side oriented toward said and interacting with said counterconical regulator link, and including an adjusting device for relative axial adjustment between the jacket and the counterconical regulator link.

5. A thread transport device in accordance with claim 1, wherein the contact pressure roller is arranged at the free portion of a unilaterally pivoted lever, which is pretensioned against the transport roller.

6. A thread transport device in accordance with claim 1, wherein the thread partially loops around the transport roller and can be removed via the contact pressure roller, the thread also being partially looped around the contact pressure roller.

7. A thread transport device in accordance with claim 1, wherein the shaft of the transport roller is connected to a variable speed driving device.

8. A thread transport device for a textile machine, including but not limited to a ribbon loom comprising:

a shaft;

a drivable transport roller with variable circumferential speeds and a friction surface arranged on said shaft; and a pretensioned contact pressure roller with inclusion of a thread to be transported, against the transport roller, wherein the regulator device has a regulator block of substantially incompressible elastomer material arranged between the shaft and the jacket, with a support device being interconnected to said jacket, said regulator block being clamped, in an axial direction, between two presser links counteracting each other, at least one of said presser links being adjustable.

9. A thread transport device in accordance with claim 8, wherein, a threaded section is provided on the shaft and is arranged on an adjusting nut that interacts with the adjustable presser link.

10. A thread transport device in accordance with claim 4, including a stationary adjusting device which comprises driving means that interact, via a coupling line, with the adjustable presser link.

11. A thread transport device for a textile machine, including but not limited to a ribbon loom comprising:

a shaft;

a drivable transport roller with variable circumferential speeds and a friction surface arranged on said shaft; and a pretensioned contact pressure roller with inclusion of a thread to be transported, against the transport roller, wherein the regulator device includes a counterconical regulator link on said shaft carrying said transport roller, and the expandable jacket has a conical inner side oriented toward said and interacting with said counterconical regulator link, the jacket and the counterconical regulator link being adjustable relative to each other in an axial direction by means of an adjusting device.

12. A thread transport device in accordance with claim 11, wherein the counterconical regulator link is arranged stationary on the shaft of the transport roller and that the adjusting device has a sleeve acting laterally on the jacket which, by means of an adjusting disk, is adjustable coaxial to the shaft of the transport roller.

13. A thread transport device in accordance with claim 12, wherein the adjusting disk has a central threaded orifice which is arranged on a threaded section of the shaft of the transport roller (10*a*).

14. A thread transport device in accordance with claim 6, including a stationary adjusting device including driving means that interact with the presser link or the adjusting link via a coupling link.

15. A thread transport device in accordance with claim 12, including a stationary adjusting device which comprises driving means that interact, via a coupling link 82, with the adjusting disk.

16. A thread transport device for a textile machine, including but not limited to a ribbon loom comprising:

a shaft;

a drivable transport roller with variable circumferential speeds and a friction surface arranged on said shaft; and a pretensioned contact pressure roller with inclusion of a thread to be transported, against the transport roller, wherein the friction surface is formed by a seamless jacket that is radially expandable by means of a regulator device, and wherein the transport roller and the contact pressure roller are followed by a pneumatic compensation device for the thread.

17. A thread transport device for a textile machine, including but not limited to a ribbon loom comprising:

a shaft;

a drivable transport roller with variable circumferential speeds and a friction surface arranged on said shaft; and a pretensioned contact pressure roller with inclusion of a thread to be transported, against the transport roller, wherein the friction surface is formed by a seamless jacket that is radially expandable by means of a regulator device, and including at least two thread transport devices and a joint drivable shaft carrying said thread transport devices.

* * * * *